US008833892B2

(12) United States Patent
Utsunomiya

(10) Patent No.: US 8,833,892 B2
(45) Date of Patent: Sep. 16, 2014

(54) PRINTING APPARATUS AND PRINTING METHOD

(71) Applicant: Seiko Epson Corporation, Tokyo (JP)

(72) Inventor: Kohei Utsunomiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/849,406

(22) Filed: Mar. 22, 2013

(65) Prior Publication Data

US 2013/0328955 A1 Dec. 12, 2013

(30) Foreign Application Priority Data

Jun. 12, 2012 (JP) ..... 2012-132772
Jun. 12, 2012 (JP) ..... 2012-132773

(51) Int. Cl.

| | |
|---|---|
| ***B41J 29/38*** | (2006.01) |
| ***B41J 2/21*** | (2006.01) |
| ***B41J 3/28*** | (2006.01) |
| ***B41J 11/00*** | (2006.01) |

(52) U.S. Cl.

CPC ..... *B41J 11/008* (2013.01); *B41J 2/2103* (2013.01); *B41J 3/28* (2013.01); *B41J 2/2117* (2013.01)

USPC ..... 347/12; 347/40; 347/100

(58) Field of Classification Search

USPC ..... 347/12, 13, 40, 43, 44, 100

See application file for complete search history.

(56) References Cited

U.S. PATENT DOCUMENTS

| | | | | |
|---|---|---|---|---|
| 6,480,217 | B1 | 11/2002 | Inoue et al. | |
| 7,407,277 | B2 | 8/2008 | Yoneyama | |
| 2010/0165036 | A1* | 7/2010 | Suzuki | 347/19 |
| 2010/0207975 | A1* | 8/2010 | Kawakami et al. | 347/9 |

FOREIGN PATENT DOCUMENTS

| | | | |
|---|---|---|---|
| JP | 05-064870 | A | 3/1993 |
| JP | 2001-001560 | A | 1/2001 |
| JP | 2006-247991 | A | 9/2006 |
| WO | 2005/105452 | A1 | 10/2005 |

* cited by examiner

*Primary Examiner* — Juanita D Jackson

(74) *Attorney, Agent, or Firm* — Maschoff Brennan

(57) ABSTRACT

A printing apparatus comprising: a print head which relatively moves on a printing medium, and a print control unit that controls the print mechanism, a plurality of nozzle columns are formed in the print head, wherein the print control unit is configured to execute printing by using a first nozzle use setting configured such that a first group of a first nozzle column on an upper stream side is used and a second group of a second nozzle column on the downstream side is used, or a second nozzle use setting configured such that an entire third column is used, and a third nozzle use setting configured such that a third group of the second nozzle column on the upper stream side is used, and a fourth group of the first nozzle column on the downstream side is used in order of each first, second, and third nozzle use setting.

6 Claims, 6 Drawing Sheets

FIRST NOZZLE USE SETTING

SECOND NOZZLE USE SETTING

THIRD NOZZLE USE SETTING

PRINTING APPARATUS AND PRINTING METHOD

CROSS-REFERENCE TO RELATED APPLICATIONS

The entire disclosure of Japanese Patent Application No. 2012-132772, filed Jun. 12, 2012 and 2012-132773, filed Jun. 12, 2012 are expressly incorporated by reference herein.

BACKGROUND

1. Technical Field

The present invention relates to a technology which prints an image which includes a multi-layered ink layer.

2. Related Art

As one of ink jet printers, a serial-type ink jet printer has been known that forms an image by discharging ink from a print head while moving the print head in the main scan direction and the sub scan direction. In addition, a technology has been known that prints an image which includes a multi-layered ink layer using the ink jet printer.

For example, JP-A-2006-247991 discloses a technology that forms an under layer on a transparent printing medium using white ink, and performs printing on the formed under layer using process color ink. In addition, JP-A-2006-247991 discloses a technology (hereinafter, referred to as a nozzle division technology) that discharges one of the white ink and the process color ink using an upper stream side nozzle group of nozzle columns which are formed on the print head for each kind of ink, and discharges the other side ink using a downstream side nozzle group. According to the nozzle division technology, it is possible to form a two-layered ink layer while the printing medium is transported one time throughout the length of the printing medium.

JP-A-2001-1560, WO 2005/105452, and JP-A-5-64870 are examples of the related art.

When a print matter which includes a five or more-layered ink layer is printed using such a multi-layer printing technology, various problems may occur. The print matter which includes the five or more-layered ink layer can employ a print matter in which, for example, a first color layer which is formed by color ink, a first specific gloss layer which is formed by specific gloss ink, an under layer which is formed by white ink, a second specific gloss layer which is formed by the specific gloss ink, and a second color layer which is formed by the color ink are formed on the transparent printing medium. The specific gloss ink is ink which reveals specific gloss such as metallic texture. The print matter can employ a print matter which enables an image to be visible from both surfaces of the printing medium.

However, when five layers are formed on one side surface of the printing medium, if the five layers are configured in such a way that a nozzle column is divided into five nozzle groups using the above-described nozzle division technology and each of the nozzle groups obtained through the division forms a single layer, the number of nozzles for each single nozzle group obtained through division becomes small. As a result, a range which can be printed using a single nozzle group becomes small, and thus a printing speed becomes extremely slow.

On the other hand, when the nozzle division technology is not used, only a single-layered ink layer is formed during a process to transport the printing medium one time throughout the length of the printing medium. Therefore, in order to form a five-layered ink layer, it is necessary to repeat the process five times. With regard to the repetition of the process to transport the printing medium, a method of automatically reversing the feed direction of the printing medium and a method of repeatedly setting the printing medium to an initial position by a manual operation are conceivable. In both methods, it is difficult to avoid the slight deviation of the position of the printing medium during a plurality of transport processes. That is, the relative position of each layer of the print surface is deviated from a prescribed original position. For example, if the positional relationship between the first color layer and the first specific gloss layer is deviated, the feeling of specific gloss to be revealed varies. As a result, there is a problem in that the deterioration of print quality may occur.

In addition, when three layers are formed on one side surface of the printing medium and two layers are formed on the other side surface, there is a case in which a problem occurs as a result that both the side surfaces of the printing medium are printed. For example, when a print matter, both side surfaces of which are printed, comes into contact with the window of a premise such that printed content can be viewed from either on or off the premise, a printed surface of one side is directly pasted on the window. In this case, there is a problem in that ink adheres to the window. That is, when the pasted print matter is taken off, it is necessary to remove the adhered ink.

SUMMARY

An advantage of some aspects of the invention is to provide a new printing technology that can preferably print a print matter which includes a five or more-layered ink layer.

The invention can be realized in the following forms or Application Examples.

APPLICATION EXAMPLE 1

According to Application Example 1, there is provided a printing apparatus including: a print mechanism that performs printing by discharging ink from a print head which relatively moves on the printing medium in a main scan direction and a sub scan direction which intersects the main scan direction; and a print control unit that controls an operation of the print mechanism. In the print head, a plurality of nozzle columns, obtained in such a way that a plurality of nozzles which discharge the ink are arranged in lines in a predetermined range in the sub scan direction, are formed in lines in the main scan direction for each kind of the ink. The print control unit is configured to enable printing to be performed on one side surface of the printing medium by using a first nozzle use setting configured such that, in a first nozzle column of the plurality of nozzle columns, a first nozzle group, which is formed on an upper stream side opposite to a downstream side on which the printing medium moves with regard to the print head, is used as a use range in the predetermined range, and, in a second nozzle column which is different from the first nozzle column, a second nozzle group, which is formed on the downstream side rather than the first nozzle group, is used as the use range, a second nozzle use setting configured such that an entire of a third nozzle column, which is different from the first nozzle column and the second nozzle column, is used as the use range, and a third nozzle use setting configured such that, in the second nozzle column, a third nozzle group, which is formed on the upper stream side rather than the second nozzle group, is used as the use range, and, in the first nozzle column, a fourth nozzle group, which is formed on the downstream side rather than the first nozzle group is used as the use range in order of the first nozzle use setting, the second nozzle use setting, and the third nozzle use setting.

In this case, on one side surface of the printing medium, it is possible to print a print matter which includes a five-layered ink layer which is formed in order of an ink layer which is formed by the first nozzle column, an ink layer which is formed by the second nozzle column, an ink layer which is formed by the third nozzle column, an ink layer which is formed by the second nozzle column, and an ink layer which is formed by the first nozzle column when viewed from the printing medium. Therefore, if printing is performed on a transparent printing medium, it is possible to obtain a print matter in which a printed image can be viewed from both opposite surfaces of the printing medium. In addition, during a transport process to transport the printing medium one time throughout the length of the printing medium (the length of the sub scan direction), it is possible to form a two-layered ink layer using the first nozzle use setting. In addition, during a separate one transport process it is possible to form a two-layered ink layer using the third nozzle use setting. That is, a two-layered ink layer is formed by performing one transport process. Therefore, compared to a case in which a single-layered ink layer is formed for one transport process, the deviation of relative positional relationship seldom occurs between the two layers. Therefore, it is possible to restrain print quality from being deteriorated. In addition, it is possible to print an ink layer corresponding to the five layers by performing the three times of transport processes using the respective first to third nozzle use settings. Therefore, compared to a case in which an ink layer corresponding to five layers is printed by performing one transport process in such a way that the nozzle column is divided into five nozzle groups and the five nozzle groups are used, it is possible to increase the printing speed. However, printing can be performed on only one surface of the opposite two surfaces of the printing medium. Therefore, if the other surface comes into contact with and is pasted on a transparent member such as window, ink does not adhere to the transparent member. Meanwhile, the first to third nozzle columns may be singular numbers or plural numbers, respectively.

APPLICATION EXAMPLE 2

In the printing apparatus according to Application Example 1, the image which includes the five-layered ink layer may be printed in such a way that a two-layered ink layer is formed when the printing is performed using the first nozzle use setting, a single-layered ink layer is formed when the printing is performed using the second nozzle use setting, and the two-layered ink layer is formed when the printing is performed using the third nozzle use setting.

In this case, it is possible to preferably print a printed matter which includes a five-layered ink layer.

APPLICATION EXAMPLE 3

In the printing apparatus according to Application Example 1 or 2, the second nozzle column may be a nozzle column which discharges metallic ink.

In this case, it is possible to preferably print a print matter in which a printed image which includes the metallic texture can be viewed when viewed from either of the two opposite side surfaces of the printing medium.

APPLICATION EXAMPLE 4

In the printing apparatus according to any one of Application Examples 1 to 3, the third nozzle column may be a nozzle column which discharges white ink.

In this case, it is possible to form an under layer using the white ink. Therefore, it is difficult for light to transmit the printed surface of the print matter. Therefore, even when the printing medium is viewed from either of both side surfaces of the printing medium, it is possible to make the reproducibility of the color of the printed image be excellent.

APPLICATION EXAMPLE 5

In the printing apparatus according to any one of Application Examples 1 to 4, the print mechanism may include a transport unit that transports the printing medium in a first direction of the sub scan direction when the printing is performed using the first nozzle use setting, transports the printing medium in a second direction which is reverse of the first direction when the printing is performed using the second nozzle use setting, and transports the printing medium in the first direction when the printing is performed using the third nozzle use setting.

In this case, it is possible to automatically reverse the transport direction of the printing medium. Therefore, whenever the transport of the printing medium in a single direction ends, a user does not need to reset the printing medium to a predetermined initial position. Therefore, the convenience of the user is improved. In addition, accordingly, it is possible to increase the printing speed.

The invention can be implemented in various forms. For example, in addition to the above-described printing apparatus, the invention can be implemented in forms of a printing method which will be described below as Application Example 6, a program which is used for the printing apparatus, and a storage medium which stores the program so as to be read by a computer.

APPLICATION EXAMPLE 6

According to Application Example 6, there is provided a printing method of enabling a printing apparatus to perform printing by discharging ink from a print head which relatively moves on a printing medium in a main scan direction and a sub scan direction which intersects the main scan direction, and in which a plurality of nozzle columns, obtained in such a way that a plurality of nozzles which discharge ink are arranged in lines in a predetermined range in the sub scan direction, are formed in lines in the main scan direction for each kind of the ink, the printing method including: performing printing on one side surface of the printing medium by using a first nozzle use setting configured such that, in a first nozzle column of the plurality of nozzle columns, a first nozzle group, which is formed on an upper stream side opposite to a downstream side on which the printing medium moves with regard to the print head, is used as a use range in the predetermined range, and, in a second nozzle column which is different from the first nozzle column, a second nozzle group, which is formed on the downstream side rather than the first nozzle group, is used as the use range, a second nozzle use setting configured such that an entire of a third nozzle column, which is different from the first nozzle column and the second nozzle column, is used as the use range, and a third nozzle use setting configured such that, in the second nozzle column, a third nozzle group, which is formed on the upper stream side rather than the second nozzle group, is used as the use range, and, in the first nozzle column, a fourth nozzle group, which is formed on the downstream side rather than the first nozzle group is used as the use range in order of the first nozzle use setting, the second nozzle use setting, and the third nozzle use setting.

APPLICATION EXAMPLE 7

There is provided a printing apparatus which prints an image on a printing medium, including: a print mechanism that performs printing by discharging ink from a print head which relatively moves on the printing medium in a main scan direction and a sub scan direction which intersects the main scan direction; and a print control unit that controls an operation of the print mechanism. In the print head, a plurality of nozzle columns, obtained in such a way that a plurality of nozzles which discharge the ink are arranged in lines in a predetermined range in the sub scan direction, are formed in lines in the main scan direction for each kind of the ink. The print control unit is configured to enable printing to be performed on one side surface of the printing medium by performing a first printing mode configured to perform printing on the arbitrary printing area of the printing medium by the number of first main scans throughout an entire printing area on which the image should be printed using two or more nozzle columns, which have different kinds of ink, of the plurality of nozzle columns, a second printing mode configured to perform printing by the number of second main scans throughout the entire printing area using one or more nozzle columns of the plurality of nozzle columns, and a third printing mode configured to perform printing by the number of third main scans throughout the entire printing area using two or more nozzle columns, which have different kinds of ink, of the plurality of nozzle columns in order of the first printing mode, the second printing mode, and the third printing mode. The number of second main scans is smaller than the number of first main scans and the number of third main scans.

In this case, in the first printing mode, it is possible to form the two-layered ink layer by discharging ink to the same printing area at different timings between two or more nozzle columns which have different kinds of ink. It is the same as the third printing mode. That is, it is possible to print a print matter, which includes a five-layered ink layer formed in order of a two-layered ink layer formed in the first printing mode, a single-layered ink layer formed in the second printing mode, and a two-layered ink layer formed in the third printing mode when viewed from the printing medium, on one side surface of the printing medium. Therefore, if printing is performed on a transparent printing medium, it is possible to obtain a print matter which enables a printed image to be viewed from both opposite surfaces of the printing medium.

In addition, according to the printing apparatus, it is possible to form the two-layered ink layer using two or more nozzle columns during a transport process to transport the printing medium throughout the length of the printing medium (the length of the sub scan direction) one time in the first printing mode. In addition, it is possible to form the two-layered ink layer using two or more nozzle columns during a separate one transport process in the third printing mode. That is, since the two-layered ink layer is formed by performing the transport process one time, the deviation of relative positional relationship seldom occurs between the two layers, compared to a case in which a single-layered ink layer is formed for one transport process. Therefore, it is possible to restrain print quality from being deteriorated.

In addition, it is possible to print an ink layer corresponding to the five layers by performing one transport process on the first to third printing modes respectively.

Therefore, compared to a case in which an ink layer corresponding to the five layers is printed by performing one transport process in such a way that the nozzle column is divided into five nozzle groups and the five nozzle groups are used, it is possible to increase the printing speed.

However, printing may be performed on only one surface of the opposite two surfaces of the printing medium. Therefore, if the other side surface comes into contact with and is pasted on a transparent member such as window, ink does not adhere to the transparent member. Meanwhile, the first to third nozzle columns may be singular numbers or plural numbers, respectively.

APPLICATION EXAMPLE 8

In the printing apparatus according to Application Example 1, at least one of the plurality of nozzle columns may be a metallic nozzle column which discharges metallic ink, and each of the two or more nozzle columns in the first printing mode and each of the two or more nozzle columns in the third printing mode may include the metallic nozzle column.

In this case, it is possible to preferably print a print matter in which a printed image which includes metallic texture can be viewed when viewed from either of the two opposite surfaces of the printing medium.

APPLICATION EXAMPLE 9

In the printing apparatus according to any one of Application Example 1 or 2, the print control unit may form a first under layer in the second printing mode, and the print head discharges ink, used to form the second under layer which is positioned between the first under layer and the printing medium, in only the last main scan of the number of the first main scans in the first printing mode.

In this case, since the second under layer is formed using only the last main scan, it is possible to increase the printing speed, compared to a case in which the second under layer is formed using the multiple times of main scans.

APPLICATION EXAMPLE 10

In the printing apparatus according to any one of Application Examples 1 to 3, the print mechanism may include a transport unit that transports the printing medium in the first direction of the sub scan direction when the printing is performed in the first printing mode, transports the printing medium in the second direction which is in reverse direction to the first direction when the printing is performed in the second printing mode, and transports the printing medium in the first direction when the printing is performed in the third printing mode.

In this case, it is possible to automatically reverse the transport direction of the printing medium. Therefore, whenever the transport of the printing medium in a single direction ends, the user does not need to reset the printing medium to a predetermined initial position. Therefore, the convenience of the user is improved. In addition, accordingly, it is possible to increase the printing speed.

The invention can be implemented in various forms. For example, in addition to the above-described printing apparatus, the invention can be implemented in forms of a printing method which will be described below according to Application Example 11, a program which is used for the printing apparatus, and a storage medium which stores the program so as to be read by a computer.

APPLICATION EXAMPLE 11

According to Application Example 11, there is provided a printing method of enabling a printing apparatus to perform printing by discharging ink from a print head which relatively moves on a printing medium in a main scan direction and a sub scan direction which intersects the main scan direction, and in which a plurality of nozzle columns obtained in such a way that a plurality of nozzles which discharge ink are arranged in lines in a predetermined range in the sub scan direction are formed in lines in the main scan direction for each kind of the ink, the printing method including: performing printing on one side surface of the printing medium by performing a first printing mode configured to perform printing on the arbitrary printing area of the printing medium by the number of first main scans using two or more nozzle columns of the plurality of nozzle columns, a second printing mode configured to perform printing by the number of second main scans using one or more nozzle columns of the plurality of nozzle columns, and a third printing mode configured to perform printing by the number of third main scans using two or more nozzle columns of the plurality of nozzle columns in order of the first printing mode, the second printing mode, and the third printing mode. The number of second main scans is less than the number of first main scans and the number of third main scans.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Example

A-1. Configuration of Printer

Figure 1:
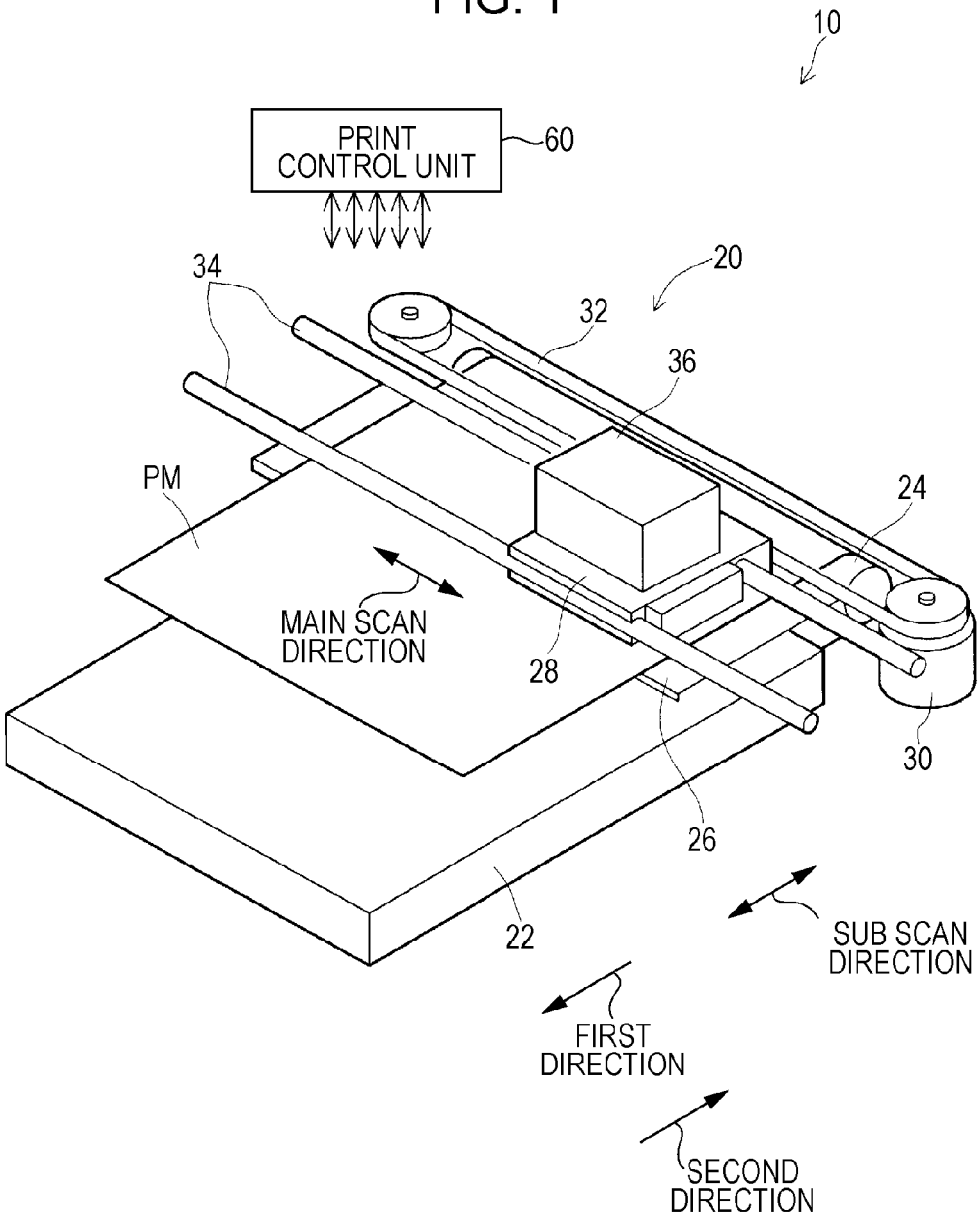
FIG. 1 is a schematic perspective view illustrating a main configuration of a printer which is an example of the invention.

FIG. 1 is a schematic perspective view illustrating a main configuration of the printer 10 which is an example of a printing apparatus of the invention. The printer 10 is an ink jet-type printing apparatus which forms ink dots on a printing medium by discharging ink from a plurality of nozzles, and records letters, figures, and images on the printing medium. The printer 10 is a so-called serial-type printer.

The printer 10 includes a print mechanism 20 and a print control unit 60. The print mechanism 20 performs printing on the printing medium by discharging ink from print head 36 (which will be described in detail later) which relatively moves in a main scan direction and a sub scan direction which intersects the main scan direction. The sub scan direction is a direction in which the printing medium is transported. The print control unit 60 includes a CPU which processes various kinds of operations, a RAM which temporarily stores or deploys a program or data, and an EEPROM which stores the program executed by the CPU. The print control unit 60 exchanges a signal with each of the units of the print mechanism 20, and controls the whole operation of the print mechanism 20.

The print mechanism 20 includes a paper stacker 22, a paper feed roller 24 which is driven by a printing medium transport mechanism 40 (not shown in FIG. 1), a platen 26, a carriage 28, a carriage motor 30, a tow belt 32 which is driven by the carriage motor 30, and a guide rail 34 which is used for the carriage 28. The paper feed roller 24 configures a part of the printing medium transport mechanism 40 which will be described later. A print head 36 which includes the plurality of nozzles is mounted on the carriage 28.

A printing medium PM is wound from the paper stacker 22 by the paper feed roller 24, and is transmitted in the sub scan direction on the surface of the platen 26. The carriage 28 is towed by the tow belt 32 which is driven by the carriage motor 30, and moves in the main scan direction along the guide rail 34. In the example, main scan direction is perpendicular to the sub scan direction.

Figure 2:
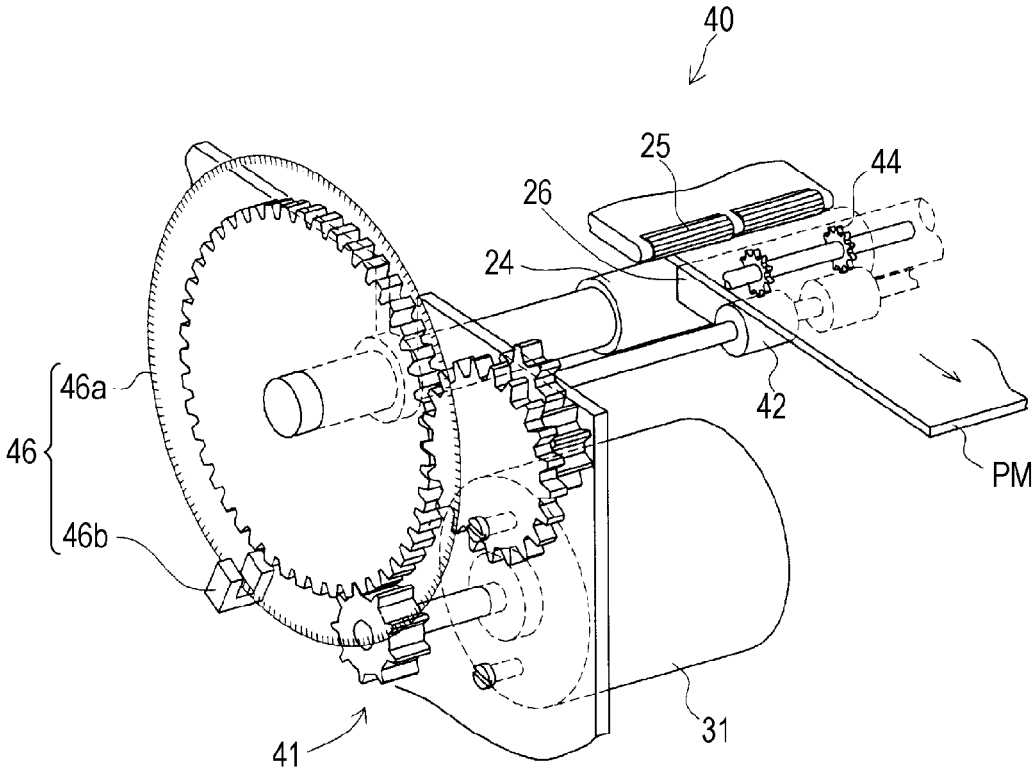
FIG. 2 is a perspective view illustrating a configuration of a printing medium transport mechanism.

FIG. 2 is a perspective view illustrating a configuration of the printing medium transport mechanism 40. The printing medium transport mechanism 40 includes the paper feed roller 24, a paper feed motor 31, a gear train 41, a paper ejection roller 42 and the like. The power of the paper feed motor 31 is transmitted to the paper feed roller 24 and the paper ejection roller 42 through the gear train 41. The paper feed roller 24 is provided with a driven roller 25, and the paper ejection roller 42 is also provided with a Giza roller 44 as the driven roller. The printing medium PM is transmitted in a state in which the printing medium is interposed between the rollers, and moves on the platen 26.

In the example, the printing medium transport mechanism 40 can transport the printing medium PM in a first direction and a second direction by performing forward reverse control on the paper feed motor 31 (refer to FIG. 1). The second direction is the reverse direction of the first direction. The first direction is the transport direction of the printing medium PM in a case in which printing is completed by transporting one time the printing medium PM in the length of the printing medium PM (the length of the sub scan direction), that is, throughout the entire printing area in which an image should be printed. As described above, automatically reversing the transport direction of the printing medium PM is called back feed.

The shaft of the paper feed roller 24 is provided with a rotary encoder 46 which includes a coding disk 46*a* and a photo sensor 46*b*. The paper feed amount (sub-scan feed amount) is determined in response to a pulse signal from the rotary encoder 46.

Figure 3:
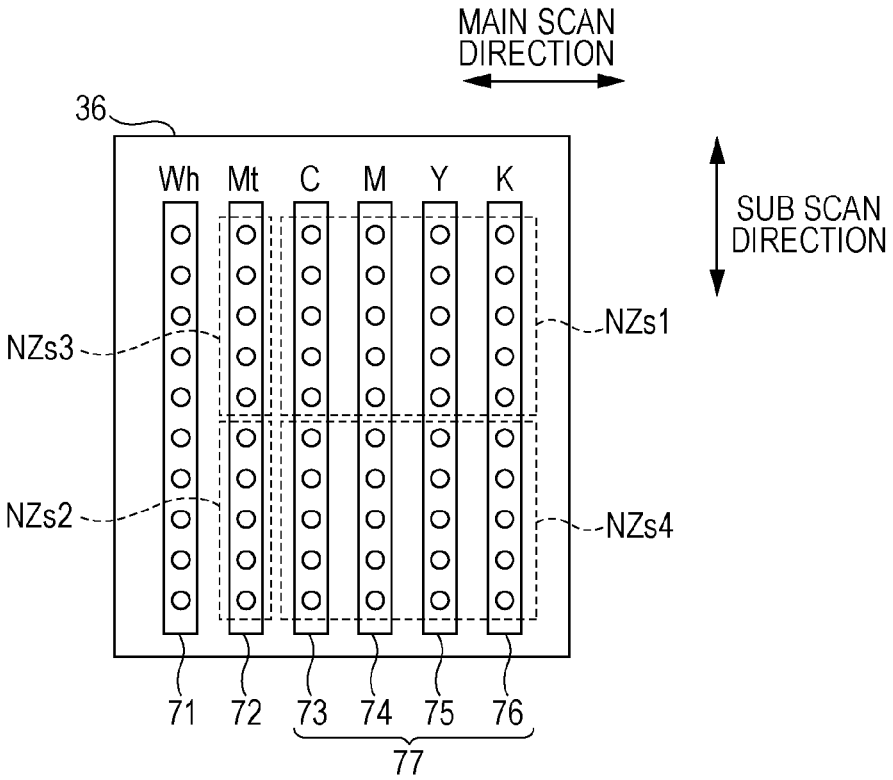
FIG. 3 is an explanatory view illustrating the arrangement of the nozzles of a print head.

FIG. 3 illustrates the arrangement of the nozzles which are formed in the print head 36. The nozzles shown in the drawing are formed on the under surface of the print head 36, that is, on a surface which faces the printing medium PM. An image is formed on the printing medium PM using ink discharged from the nozzles. In the example, the print head 36 discharges 6 types of ink, more specifically, cyan ink C, magenta ink M, yellow ink Y, black ink K, metallic ink Mt, and white ink Wh. The ink is supplied from an ink cartridge (not shown in FIG. 1) which is mounted in the printer 10.

The cyan ink C, the magenta ink M, the yellow ink Y, and the black ink K are ink used to reproduce hue, brightness, and chroma. The ink is collectively called color ink Col. In the specification, the color ink Col includes black ink, and is not limited to cyan, magenta, and yellow. The color ink Col means one or more hues of ink, such as red, orange, green, and blue. It is possible to take the color ink if the ink forms an image layer. The metallic ink Mt is a kind of specific gloss ink which reveals a special texture. The metallic ink Mt includes metallic pigment, thereby revealing metallic texture. The white ink Wh is ink which is used to form an under layer. The ink which forms the under layer is not limited to the white ink Wh. The ink may be white ink with a little white hue and may be ink which reproduces arbitrary hue.

As shown in FIG. 3, a plurality of nozzle columns 71 to 76, in which the plurality of nozzles are arranged in lines in specific ranges in the sub scan direction, are formed in the print head 36. The nozzle columns are formed in lines for the respective kinds of ink in the main scan direction. The nozzle column 71 which discharges the white ink Wh is also called a white nozzle column 71. The nozzle column 72 which discharges the metallic ink Mt is also called a metallic nozzle column 72. In addition, the nozzle columns 73 to 76 which discharge ink C, M, Y, and K are also called a color nozzle column 77.

When the color nozzle column 77 is equally divided into two in the sub scan direction, one side nozzle group is called a first nozzle group NZs1 and the other side nozzle group is called a fourth nozzle group NZs4. In addition, when the metallic nozzle column 72 is equally divided into two in the sub scan direction, one side (the side of the fourth nozzle group NZs4) nozzle group is called a second nozzle group NZs2 and the other side (the side of the first nozzle group NZs1) nozzle group is called a third nozzle group NZs3.

In the printer 10 which performs printing using the print head 36, the print control unit 60 is configured to enable print control based on first to third nozzle use settings. In the first to the third nozzle use settings, the kinds of the nozzle columns to be used and the positions of the nozzle groups are different from each other. The details of the first to the third nozzle use settings will be described later.

Figure 4:
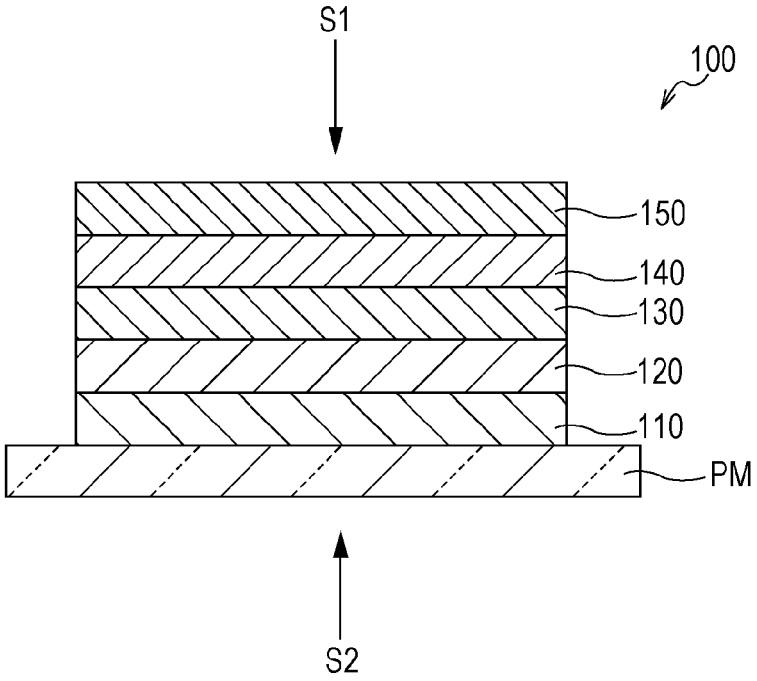
FIG. 4 is an explanatory view illustrating a cross-sectional configuration of a print matter which can be printed by the printer.

FIG. 4 illustrates the configuration of the cross section of the print matter 100 which can be printed by the above-described printer 10. A transparent printing medium PM is used for the print matter 100. A five-layered ink layer is formed on one side surface of the printing medium PM by the printer 10. The 5 layers are formed in order of a first color ink layer 110, a first metallic layer 120, a white layer 130, a second metallic layer 140, and a second color layer 150 when viewed from the side of the printing medium PM. The first color ink layer 110 and the second color layer 150 are formed by the color nozzle column 77. The first metallic layer 120 and the second metallic layer 140 are formed by the metallic nozzle 72. The white layer 130 is formed by the white nozzle column 71. In addition, it is possible to take the white layer 130 as the first under layer, and to take the first metallic layer 120 and the second metallic layer 140 as the second under layer.

The five-layered configuration is conceptual based on the order in which each layer is formed. Therefore, ink dots which have different kinds of color are not necessarily overlapped and formed in 5 layers in the direction which is perpendicular to the print surface of the printing medium PM. For example, the second color layer 150 may include an area in which the dots of the color ink Col are not formed. Otherwise, the dots of the color ink Col may not be formed as the second color layer 150 in an area which is included in the second metallic layer 140 and in which the dots of the metallic ink Mt are formed, and the dots of the color ink Col may be formed as the second color layer 150 in an area which is included in the second metallic layer 140 and in which the dots of the metallic ink Mt are not formed. In this case, there may be an aspect in which the second metallic layer 140 and the second color layer 150 are formed in approximately the same position in the direction which is perpendicular to the surface of the printing medium PM. In the specification, such an aspect is included in the ink layer have the five-layered configuration.

When the print matter 100 is viewed from a side on which the ink layer is formed (S1 side in FIG. 4), it is possible to view the image of the second color layer 150 having the metallic texture which is revealed due to the second metallic layer. On the other hand, when the print matter 100 is viewed from a side on which the ink layer is not formed (S2 side in FIG. 4), it is possible to view the image of the first color ink layer 110 having the metallic texture which is revealed due to the first metallic layer 120 because the printing medium PM is transparent.

Figure 5:
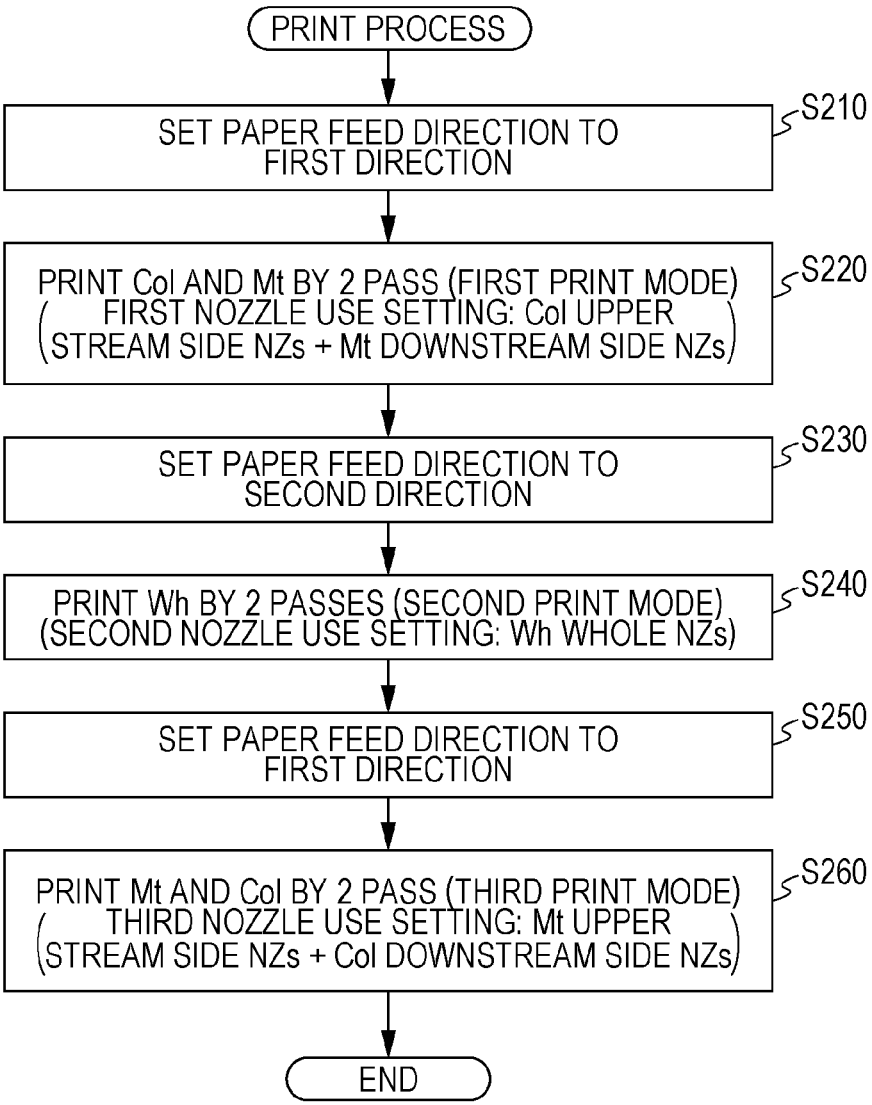
FIG. 5 is a flowchart illustrating the flow of a printing process in order to print the print matter.

FIG. 5 illustrates the flow of a printing process to print the print matter 100 using the printer 10. When a print command is received, the print control unit 60 of the printer 10 first sets a paper feed direction (the transport direction of the printing medium PM) to a first direction in step S210. Subsequently, the print control unit 60 prints the first color ink layer 110 and the first metallic layer 120 by repeating a process to perform the sub scan in the first direction by predetermined amount after discharging ink from the print head 36 based on the first nozzle use setting while performing main scan in step S220. A print operation in step S220 is called a first printing mode.

Figure 6:
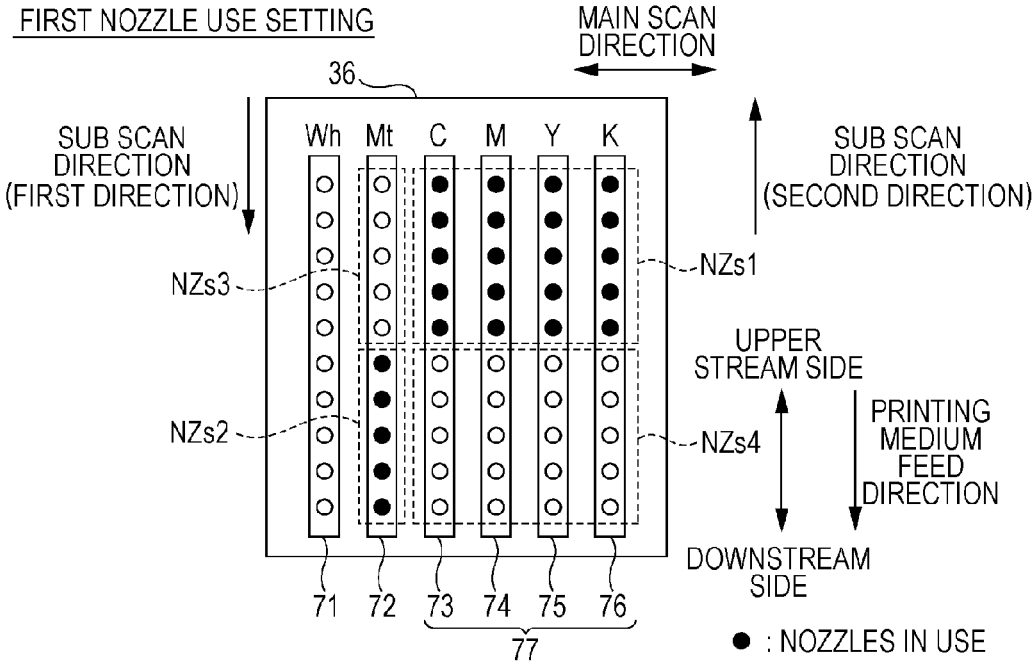
FIG. 6 is an explanatory view illustrating first nozzle use setting.

FIG. 6 illustrates the content of the first nozzle use setting. In the first nozzle use setting, the color nozzle column 77 and the metallic nozzle column 72 are used, and the white nozzle column 71 is not used. In addition, the first nozzle group NZs1 of the color nozzle column 77 is used and the fourth nozzle group NZs4 is not used. In addition, the second nozzle group NZs2 of the metallic nozzle column 72 is used and the third nozzle group NZs3 is not used. The first nozzle group NZs1 and the second nozzle group NZs2 are used for each main scan.

When the printing medium PM is transported in the first direction, the first nozzle group NZs1 and the third nozzle group NZs3 are positioned on an upper stream side, and the fourth nozzle group NZs4 and the second nozzle group NZs2 are positioned on a downstream side. The downstream side is a side on which the printing medium PM moves with respect to the print head 36 when the print head 36 and the printing medium PM relatively move and print is performed. The upper stream side is the reverse side of the downstream side. In other words, the upper stream side is a side that ink is discharged relatively first to the same area of the transported printing medium PM, and the downstream side is a side that ink is discharged relatively later. That is, under the print control based on the first nozzle use setting, the dots of the color ink Col are formed in advance in the arbitrary area of the printing medium PM by first main scan, and then the dots of the metallic ink Mt are formed by second main scan (main scan which is performed after the first main scan).

In the example, the first color ink layer 110 and the first metallic layer 120 of the arbitrary printing area are formed by two main scans (hereinafter, the number of main scans is called the number of passes). More specifically, the first color ink layer 110 of the width of the sub scan direction corresponding to the first nozzle group NZs1 is formed on the upper stream side by one main scan, and, at the same time, the first metallic layer 120 of the width of the sub scan direction corresponding to the fourth nozzle group NZs4 is formed on the downstream side. Thereafter, after the printing medium PM is transported in the sub scan direction by the amount of the first nozzle group NZs1 (fourth nozzle group NZs4), the first color ink layer 110 of the width of the sub scan direction corresponding to the first nozzle group NZs1 is formed by a subsequent main scan, and, at the same time, the first metallic layer 120 of the width of the sub scan direction corresponding to the fourth nozzle group NZs4 is formed on the downstream side. Therefore, on the first color ink layer 110 which is formed by the first main scan, the first metallic layer 120 is formed by the subsequent main scan.

As is clear from the above description, in the example, the printer 10 forms a single raster by one main scan. The raster is a line of ink dots in the main scan direction. In addition, the printer 10 forms ink dots using a so-called band feed method. The band feed method is a method of completing rasters, which are continuous in the sub scan direction for one main scan, by the width of the nozzle group which discharges ink. However, the printer 10 may form a single raster by performing a plurality of main scans. In addition, the printer 10 may form ink dots using an interlacing method. The interlacing method is a method of forming a separate raster between adjacent two rasters, which are formed by one main scan, by performing at least one separate main scan. Even when the interlacing method is used, it is possible to preferably form the first metallic layer 120 on the first color ink layer 110 in an arbitrary printing area by dividing the nozzle column into the upper stream side and the downstream side and using them. As is clear from the above description, in step S220, the number of passes which forms the first color ink layer 110 and the first metallic layer 120 of an arbitrary printing area (a printing area which includes two or more pixels in the main scan direction and the sub scan direction) is defined as 2×M times (M is an integer which is equal to or greater than 1). If the value of M becomes large, it is possible to restrain the deterioration of the quality of a printed image due to so-called banding in which the joint between areas which are printed by performing one scan is recognized as a lateral stripe.

In addition, in the example, the print control unit 60 performs control such that the dot formation position of the first color ink layer 110 does not overlap with the first color ink layer 110 of the first metallic layer 120 as much as possible. The control is called overlap restraint control. It is possible to perform the overlap restraint control using various methods. With regard to the control, hereinafter, a halftone process to determine the ON/OFF of dots at each pixel position based on print target image data will be described as a process which is performed using an organized dither method. Meanwhile, the overlap restraint control may be appropriately used depending on desired print quality, and is not essential control.

As a first method of the overlap restraint control, it is possible to exemplify a method of using dither masks which have the different arrangement of thresholds between the halftone process with regard to the color ink Col and the halftone process with regard to the metallic ink Mt. The arrangement of the thresholds of the dither masks indicates the pattern of dots which are formed depending on the print grayscale values. Therefore, if the same dither mask is used in both halftone processes, the dots of the color ink Col overlap with the dots of the metallic ink Mt. On the other hand, if dither masks which have the different arrangement of thresholds are used, it is possible to restrain the overlap of the dots. For example, a dither mask, which is configured with a threshold group deviated from a threshold group which configures a dither mask used for the halftone with regard to the color ink Col by predetermined pixels in a predetermined direction, may be used for the halftone process with regard to the metallic ink Mt. Accordingly, it is not have to prepare two kinds of dither masks, and thus it is possible to reduce man-hour when the printer 10 is manufactured.

As a second method of the overlap restraint control, it is possible to exemplify a method of performing a halftone process with regard to the metallic ink Mt, and then reflecting a result of the halftone process and performing a halftone process with regard to the color ink Col. More specifically, the print control unit 60 may determine the dots of the color ink Col to be OFF in a pixel position at which the dots of the metallic ink Mt is determined to be ON. In addition, the print control unit 60 may determine whether dots to be ON/OFF by comparing a value, obtained by adding the grayscale value of the metallic ink Mt in the corresponding pixel position to the grayscale value of the color ink Col, with the threshold of the dither mask in a pixel position at which the dots of the metallic ink Mt is determined to be OFF. According to the second method, it is possible to further restrain the overlap of dots.

If the overlap restraint control is performed, it is possible to restrain that chroma which is reproduced by the dots of the color ink Col from deteriorating due to the dots of the metallic ink Mt which overlap with the corresponding dots. The overlap restraint control may be performed between the metallic ink Mt and all the color ink Col, and may be performed only between parts of color ink Col. For example, the overlap restraint control may not be performed on the black ink K in which generally chroma is hardly deteriorated, and the overlap restraint control may be performed on the other color ink Col. Accordingly, it is possible to simplify the halftone process.

Here, description returns to FIG. 5. If the first color ink layer 110 and the first metallic layer 120 are formed, the print control unit 60 sets the paper feed direction to the second direction in step S230. That is, the print control unit 60 performs back feed in subsequent print.

Subsequently, the print control unit 60 prints the white layer 130 by repeating a process to discharge ink from the print head 36 based on the second nozzle use setting while performing the main scan, and to perform sub scan in the second direction by predetermined amount in step S240. The print operation in step S240 is called a second printing mode. In step S240, since the printing medium PM is transported in the second direction, the directions on the upper stream side and the downstream side are reverse to those in step S220.

Figure 7:
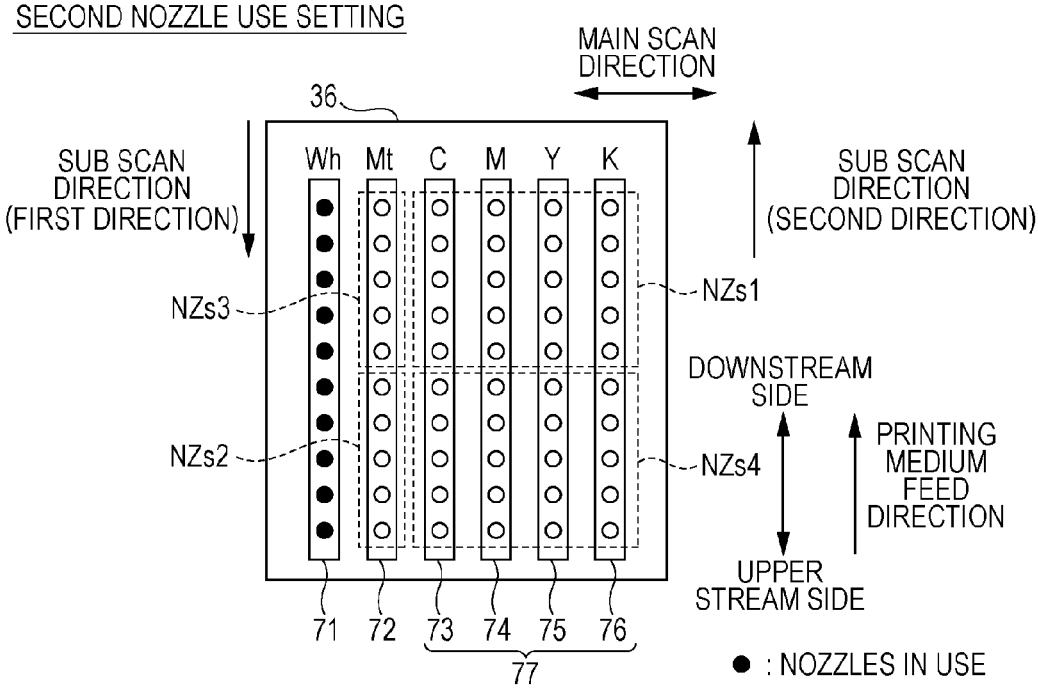
FIG. 7 is an explanatory view illustrating second nozzle use setting.

FIG. 7 illustrates the content of the second nozzle use setting. In the second nozzle use setting, only the white nozzle column 71 is used, and the color nozzle column 77 and the metallic nozzle column 72 are not used. In addition, all the nozzles which configure the white nozzle column 71 are used.

In the example, the white layer 130 in an arbitrary printing area is formed by performing one main scan. Since printing is performed by using all the ranges of the white nozzle column 71 and a small number of passes, it is possible to realize the high-speed print of the white layer 130. Since the white layer 130 functions as an under layer but is not viewed as an image, the influence of the configuration on print quality is small. However, the white layer 130 may be formed by two or more number of passes. If it is assumed that the number of passes in the second printing mode is smaller than those in the first printing mode and a third printing mode which will be described later, it is possible to realize high-speed print.

If the white layer 130 is formed, the print control unit 60 sets the paper feed direction to the first direction in step S250. That is, in print below, the print control unit 60 performs back feed again.

Subsequently, the print control unit 60 prints the second metallic layer 140 and the second color layer 150 by repeating a process to discharge ink from the print head 36 based on the third nozzle use setting while performing the main scan, and then to perform the sub scan in the first direction by predetermined amount in step S260, and terminates the printing process. The print operation in step S260 is called a third printing mode. In step S260, since the printing medium PM is transported in the first direction, the directions on the upper stream side and the downstream side are the same as those in step S220.

Figure 8:
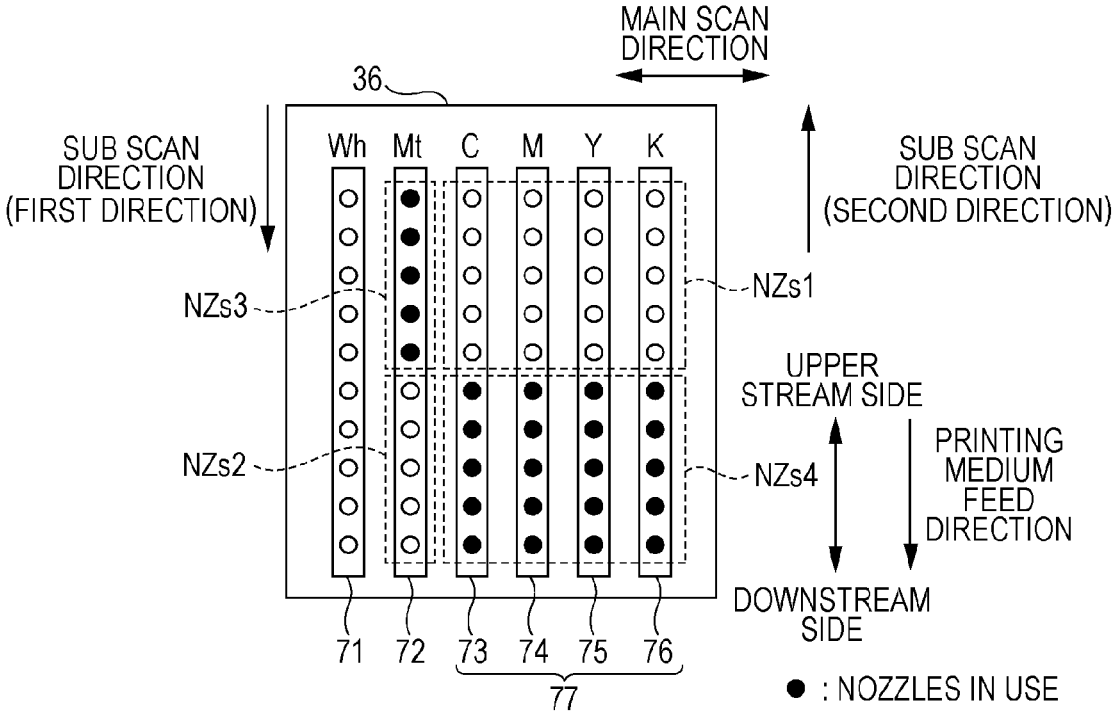
FIG. 8 is an explanatory view illustrating third nozzle use setting.

FIG. 8 illustrates the content of the third nozzle use setting. In the third nozzle use setting, the color nozzle column 77 and the metallic nozzle column 72 are used, and the white nozzle column 71 is not used. In addition, in the color nozzle column 77, the fourth nozzle group NZs4 which is positioned on the downstream side is used and the first nozzle group NZs1 which is positioned on the upper stream side is not used. In addition, in the metallic nozzle column 72, the third nozzle group NZs3 which is positioned on the upper stream side is used and the fourth nozzle group NZs4 which is positioned on the downstream side is not used. Therefore, in the print control based on the third nozzle use setting, the dots of the metallic ink Mt is previously formed in the arbitrary area of the printing medium PM by performing the first main scan, and then the dots of the color ink Col is formed in the area by performing the second main scan.

In the example, the second metallic layer 140 and the second color layer 150 in the arbitrary printing area are formed by performing two main scans like the first color ink layer 110 and the first metallic layer 120. However, here, the number of passes may be 2×times (N is an integer which is equal to or greater than 1) like the first color ink layer 110 and the first metallic layer 120.

In the above-described printer 10, the color nozzle column 77 corresponds to a first nozzle column in claims. The metallic nozzle column 72 corresponds to a second nozzle column. The white nozzle column 71 corresponds to a third nozzle column.

According to the above-described printer 10, it is possible to print the print matter 100 which includes a five-layered ink layer which is formed on one side surface of the printing medium PM in order of the first color ink layer 110, the first metallic layer 120, the white layer 130, the second metallic layer 140, and the second color layer 150 when viewed from the printing medium PM. Therefore, if printing is performed on the transparent printing medium PM, it is possible to obtain a print matter 100 in which a printed image can be viewed from both surfaces. The printer 10 may mirror-image print an image which is further formed on a side of the printing medium PM than the white layer 130 and an image which is formed on the reverse side thereof. In this way, it is possible to view the same image even when the print matter 100 is observed from either of the both surfaces. In addition, the ink layer is formed on only one side of the print matter 100. Therefore, if a surface on which the ink layer is not formed comes into contact with a transparent member, such as window, and is pasted thereto, ink does not adhere to the transparent member.

In addition, according to the printer 10, the first nozzle use setting (in the first printing mode) is used during one transport process to transport the printing medium PM in the first direction throughout the length of the printing medium PM, and thus it is possible to form two layers, that is, the first color ink layer 110 and the first metallic layer 120. Therefore, compared to a case in which the first color ink layer 110 and the first metallic layer 120 are printed using separate transport processes, deviation hardly occurs in relative position relationship between the two layers. Therefore, it is possible to restrain the deterioration of print quality. It is the same for the second metallic layer 140 and the second color layer 150.

In addition, according to the printer 10, it is possible to print an ink layer corresponding to 5 layers by performing thrice transport processes (one time for each first to third printing modes, total three transport processes) in which the first to third nozzle use settings are respectively used. Therefore, it is possible to speed up the printing speed by dividing the nozzle column into five nozzle groups and using the five nozzles columns, compared to a case in which an ink layer corresponding to 5 layers is printed by performing one transport process. Meanwhile, in a configuration in which the nozzle column is divided into five nozzle groups, in each main scan, the color ink Col is discharged from a nozzle group on the most upper stream side of the five nozzle groups which are obtained through division, the metallic ink Mt is discharged from a nozzle group on a second upper stream side, the white ink Wh is discharged from a nozzle group on a third upper stream side, the metallic ink Mt is discharged from a nozzle group on a fourth upper stream side, and the color ink Col is discharged from a nozzle group on the most downstream side.

In an aspect in which the nozzle column is divided into five nozzle groups and the five nozzle groups are used, the width of the sub scan direction of the printing medium PM, which can be recorded using a single ink when one main scan is performed, is small, compared to the example. Therefore, it is necessary to perform a sub scan, in which a transport distance is short compared to the example, multiple times. When the sub scan is performed between the main scans, a sub scan which has less feed amount than the width of a printing area is performed one time such that a gap is not generated between each of the printing areas due to before and behind main scans and such that a part of each of the printing areas overlaps with each other due to before and behind main scans. Therefore, when sub scan which has a shorter transport distance than that of the example is performed multiple times, a time that is necessary to perform printing becomes long compared to the example. Since the number of sub scans is less in the example compared to the aspect, the time that is necessary to perform printing is short.

In addition, in an aspect in which the nozzle column is divided into five nozzle groups and the five nozzle groups are used, main scans are performed by interposing a sub scan, having a short distance compared to the example, therebetween. Therefore, if printing is performed by performing the main scan immediately after the sub scan, there is a case in which it is difficult to secure a time that ink, which is recorded on the printing medium PM by performing immediately main scan, dries. In this case, it is necessary to allow a waiting time between the respective main scans in order to dry ink. Therefore, in the aspect, it is difficult to reduce a time that is necessary to perform printing in proportion as the distance of one sub scan becomes short. In the example, compared to the aspect, it is possible to secure a time that the distance of the sub scan is large and ink, which is recorded by a previous main scan, dries during the sub scan. Therefore, it is not necessary to allow the waiting time to dry ink. Therefore, in the example, a time that is necessary to perform printing is short, compared to the aspect.

Meanwhile, in the aspect in which the nozzle column is divided into five nozzle groups and the five nozzle groups are used, it is necessary to perform a sub scan, which has a short transport distance, multiple times compared to the example. Therefore, the transport distance of a sub scan due to the mechanical operation errors of the transport mechanism is more affected. Accordingly, the mutual position deviation of dots which are formed on the printing medium PM becomes large, and thus the quality of a printing result is low, compared to the example.

In addition, the time, that is necessary to perform printing, more specifically, has factors as described below. Meanwhile, here, in order to easily understand a technology, description is simplified. For example, in the aspect in which the nozzle column is divided into five nozzle groups and the five nozzle groups are used, it is necessary to perform a sub scan multiple times compared to the example, and thus the number of accelerations and decelerations, obtained when the sub scan starts and ends, is larger compared to the example. In addition, there is a case in which it is necessary to start deceleration before a predetermined speed (the highest speed which is assumed in the sub scan) is reached after acceleration starts. As a result, a time that is necessary to perform printing becomes long. In the example, since the time that the sub scan is performed at the predetermined speed (the highest speed which is assumed in the sub scan) is long between a set of acceleration and deceleration, it is possible to reduce the printing time compared to the aspect.

In addition, in the aspect in which the nozzle column is divided into five nozzle groups and the five nozzle groups are used, before the downstream end of the printing area of the printing medium PM reaches the downstream end of the print head 36 (nozzle columns) and in a state in which a part of the upper stream side of the print head 36 faces the downstream end portion of the printing area of the printing medium PM, it is necessary to perform the main scans four times while interposing the sub scans therebetween. In addition, after the upper stream end of the printing area of the printing medium PM reaches the upper stream end of the print head 36 and in a state in which a part of the downstream side of the print head 36 faces the upper stream end portion of the printing area of the printing medium PM, it is necessary to perform the main scans four times while interposing the sub scans therebetween. That is, in a state in which the print head (nozzle columns) protrudes from the upper and lower ends of the printing area of the printing medium PM, it is necessary to perform the main scans eight times while interposing the sub scans therebetween.

In contrast, in the example, in the first printing mode, before the downstream end of the printing area of the printing medium PM reaches the downstream end of the print head 36 (nozzle columns) and in a state in which the half of the upper stream side of the nozzle columns of the print head 36 faces the downstream end portion of the printing area of the printing medium PM, a single time of main scan is performed. In addition, after the upper stream end of the printing area of the printing medium PM reaches the upper stream end of the print head 36 and in a state in which the half of the downstream side of the nozzle columns of the print head 36 faces the upper stream end portion of the printing area of the printing medium PM, a single time of main scan is performed. It is the same in the third printing mode. On the other hand, in the second printing mode, it is not necessary to perform the main scan in a state in which the print head protrudes from the upper and lower ends of the printing area of the printing medium PM. That is, in the example, in the state in which the print head (nozzle columns) protrudes from the upper and lower ends of the printing area of the printing medium PM, total four times of main scans are performed. Therefore, according to the example, it is possible to increase the printing speed as much as at least the necessary number of main scans is small, compared to the aspect in which the nozzle column is divided into five nozzle groups and the five nozzle groups are used.

In addition, according to the printer 10, the white layer 130 can be formed between the first metallic layer 120 and the second metallic layer 140. Since the white layer 130 is formed as an under layer, it is difficult for light to transmit through the print surface of the print matter 100. Therefore, when the print matter 100 is viewed from either of the both surfaces of the print matter 100, it is possible to cause the reproducibility of the color of the printed image to be excellent.

In addition, according to the printer 10, it is possible to back feed the printing medium PM. Therefore, it is not necessary for a user to reset the printing medium PM to a predetermined initial position of the printer 10 whenever the transport of the printing medium PM ends in a single direction. Therefore, user convenience is improved. In addition, accordingly, it is possible to increase the printing speed. In addition, in the printer 10, a timing that reverses the transport direction of the printing medium PM is (1) between printing of the first metallic layer 120 and the second metallic layer 140 and printing of the white layer 130, and (2) between printing of the white layer 130 and printing of the second metallic layer 140 and the second color layer 150. Even though dot formation positions are deviated between the ink layers at the timings of (1) and (2), the print quality is not greatly affected if the dot formation positions are between the white layer 130, which functions as the under layer, and the other ink layers. Therefore, the print quality is not greatly lowered.

B. Modification Example

B-1. Modification Example 1

Instead of the above-described metallic ink Mt, various kinds of specific gloss ink, which includes pigment that reveals predetermined texture, may be used. The specific gloss ink exemplifies pearlescent ink which includes pigment that reveals the feeling of pearlescent after being fixed to the printing medium surface, for example, pigment in which a plurality of thin film layers having pearl colors like natural pearls overlap with each other, and lame ink and satin finish ink which include pigment that has microasperity causing irregular reflection after being fixed to the printing medium surface such that the feeling of so-called lame texture or satin finish is revealed. It is possible to take the specific gloss ink as ink in which the optical property of ink printed on the printing medium is dependent on a reflection angle.

In addition, different kinds of specific gloss ink may be used between the first metallic layer 120 and the second metallic layer 140. In this case, the print head 36 may include different nozzle columns for each kind of specific gloss ink. Otherwise, the printer 10 may be configured to discharge the specific gloss ink in which the nozzle group on the upper stream side is different from the nozzle group on the downstream side in a single nozzle column.

B-2. Modification Example 2

The print matter which is printed by the printer 10 is not limited to the print matter which includes the five-layered ink layer, and may be a print matter which includes six layers or more. For example, a covering layer may be formed on the second color layer 150 of the print matter 100 by using clear ink. In this case, after step S260 (refer to FIG. 5), the covering layer may be printed while the printing medium PM is being transported in the second direction again.

B-3. Modification Example 3

Instead of the configuration in which the printing medium PM is back fed, the printing medium PM may be reset to a predetermined initial position of the printer 10 by a manual operation of the user whenever the printing medium PM is transported in a single direction. In this case, the printer 10 performs printing by usually transporting the printing medium PM in the same direction.

B-4. Modification Example 4

At least a part of the plurality of kinds of ink which is used by the printer 10 may be ultraviolet curable ink. In this case, the printer 10 may include an ultraviolet light irradiation unit which irradiates ultraviolet light toward the printing medium PM. The ultraviolet light irradiation unit may be provided throughout the whole main scan direction on the upper stream side and the downstream side rather than the print head 36. Otherwise, the ultraviolet light irradiation unit may be provided in the print head 36. With this configuration, it is possible to restrain different kinds of ink from being mixed before being fixed to the printing medium PM.

B-5. Modification Example 5

The configuration of the nozzle column is not limited to the configuration in which the nozzle column is divided into the upper stream side and the downstream side. For example, the printer 10 may use the nozzles in such a way that the nozzles are divided into P (P is an integer which is equal to or greater than 2) and used, and may print the print matter which includes a (2P+1)-layered ink layer. In this case, printing may be performed by using, in p (p is an integer which ranges from 1 to P) nozzle columns, the first nozzle use setting which uses the use range from the upper stream side to the p-th nozzle division group, the second nozzle use setting which uses the entire (P+1) nozzle columns as the use range, and the third nozzle use setting which uses the use range from the downstream side to the p-th nozzle division group in the p nozzle in order of the first, the second, and the third nozzle use settings. Therefore, it is possible to preferably print a print matter which includes a (2P+1)-layered ink layer like the above-described example.

In this case, it is possible to assume that the number of passes, in which an arbitrary printing area is printed in the first printing mode, is P×M times. It is possible to assume that the number of passes in the second printing mode is one time. It is possible to assume that the number of passes in the third printing mode is P×N times.

B-6. Modification Example 6

The number of passes in the second printing mode is not limited to one time, and may be appropriately set in the range of the number of passes which is smaller than those in the first printing mode and the third printing mode. However, although the printing speed is slower than that of the above-described example, the same effect as that of the above-described example is shown with regard to the others. The configuration is effective in a case in which a desired hue is applied to the first under layer (the white layer 130 in the above-described example). For example, the number of passes in the second printing mode may be two. In this case, the printer 10 may discharge the white ink Wh using the entire range of the white nozzle column 71 in an initial main scan, and may discharge the color ink Col using the entire range of the color nozzle column 77 in a subsequent main scan. It is apparent that a nozzle division technology may be used like the first printing mode.

B-7. Modification Example 7

The first printing mode and the third printing mode are not limited to the print control which uses the nozzle division technology. For example, in the printing modes, after the first ink layer (for example, the first color ink layer 110) is formed by performing Q times of main scans (Q is an integer which is equal to or greater than 1) using the entire region of predetermined nozzles, the second ink layer (For example, first metallic layer 120) may be formed by performing R times of main scans (R is an integer which is equal to or greater than 1) using the entire region of the other predetermined nozzles. In this case, the first ink layer and the second ink layer are formed in a state in which a sub scan is not performed. That is, the print head 36 moves on the same printing area of the printing medium PM multiple times.

When the first ink layer is the color ink layer and the second ink layer is the metallic layer, it is preferable that the value R be equal to or less than the value Q, and it is further preferable that the value R be 1. In a case in which R=1, the second ink layer is formed by only the final main scan of the multiple times of main scans in order to print an arbitrary printing area. According to the configuration, it is possible to increase the printing speed, compared to a case in which R≥2.

Meanwhile, the invention is not limited to the above-described example and the Modification Examples, and can be implemented by various configurations without departing from the gist of the invention. For example, the embodiment and the example which correspond to the technical features of each form described in SUMMARY and the technical features of the Modification Examples can be appropriately replaced or combined in order to solve a part of or all of the above-described problems or in order to accomplish a part of or all of above-described advantages. In addition, if the technical features are not described in the specification as essence, the technical features can be appropriately omitted.

What is claimed is:

1. A printing apparatus which prints an image on a printing medium, comprising:

a print mechanism that performs printing by discharging ink from a print head which relatively moves on the printing medium in a main scan direction and a sub scan direction which intersects the main scan direction;

a print control unit that controls an operation of the print mechanism, wherein, in the print head, a plurality of nozzle columns, obtained in such a way that a plurality of nozzles which discharge the ink are arranged in lines in a predetermined range in the sub scan direction, are formed in lines in the main scan direction for each kind of the ink, wherein the print control unit is configured to enable printing to be performed on one side surface of the printing medium by using a first nozzle use setting configured such that, in a first nozzle column of the plurality of nozzle columns, a first nozzle group, which is formed on an upper stream side opposite to a downstream side on which the printing medium moves with regard to the print head, is used as a use range in the predetermined range, and, in a second nozzle column which is different from the first nozzle column, a second nozzle group, which is formed on the downstream side rather than the first nozzle group, is used as the use range, a second nozzle use setting configured such that an entire of a third nozzle column, which is different from the first nozzle column and the second nozzle column, is used as the use range, and a third nozzle use setting configured such that, in the second nozzle column, a third nozzle group, which is formed on the upper stream side rather than the second nozzle group, is used as the use range, and, in the first nozzle column, a fourth nozzle group, which is formed on the downstream side rather than the first nozzle group is used as the use range in order of the first nozzle use setting, the second nozzle use setting, and the third nozzle use setting.

2. The printing apparatus according to claim 1, wherein the image which includes a five-layered ink layer is printed in such a way that a two-layered ink layer is formed when the printing is performed using the first nozzle use setting, a single-layered ink layer is formed when the printing is performed using the second nozzle use setting, and a two-layered ink layer is formed when the printing is performed using the third nozzle use setting.

3. The printing apparatus according to claim 1, wherein the second nozzle column is a nozzle column which discharges metallic ink.

4. The printing apparatus according to claim 1, wherein the third nozzle column is a nozzle column which discharges white ink.

5. The printing apparatus according to claim 1, wherein the print mechanism includes a transport unit that transports the printing medium in a first direction of the sub scan direction when the printing is performed using the first nozzle use setting, transports the printing medium in a second direction which is reverse of the first direction when the printing is performed using the second nozzle use setting, and transports the printing medium in the first direction when the printing is performed using the third nozzle use setting.

6. A printing method of enabling a printing apparatus to perform printing by discharging ink from a print head which relatively moves on a printing medium in a main scan direction and a sub scan direction which intersects the main scan direction, and in which a plurality of nozzle columns, obtained in such a way that a plurality of nozzles which discharge ink are arranged in lines in a predetermined range in the sub scan direction, are formed in lines in the main scan direction for each kind of the ink, the printing method comprising:

performing printing on one side surface of the printing medium by using a first nozzle use setting configured such that, in a first nozzle column of the plurality of nozzle columns, a first nozzle group, which is formed on an upper stream side opposite to a downstream side on which the printing medium moves with regard to the print head, is used as a use range in the predetermined range, and, in a second nozzle column which is different from the first nozzle column, a second nozzle group, which is formed on the downstream side rather than the first nozzle group, is used as the use range, a second nozzle use setting configured such that an entire of a third nozzle column, which is different from the first nozzle column and the second nozzle column, is used as the use range, and a third nozzle use setting configured such that, in the second nozzle column, a third nozzle group, which is formed on the upper stream side rather than the second nozzle group, is used as the use range, and, in the first nozzle column, a fourth nozzle group, which is formed on the downstream side rather than the first nozzle group is used as the use range in order of the first nozzle use setting, the second nozzle use setting, and the third nozzle use setting.

* * * * *